US005655589A

United States Patent [19]

Vartanian

[11] Patent Number: 5,655,589

[45] Date of Patent: Aug. 12, 1997

[54] DECORATIVE BLIND

[76] Inventor: Ruslan Y. Vartanian, 425 Glen St., Apartment 14, Glens Falls, N.Y. 12801

[21] Appl. No.: 648,728

[22] Filed: May 16, 1996

[51] Int. Cl.[6] ..... E06B 9/26

[52] U.S. Cl. ..... 160/166.1; 160/236

[58] Field of Search ..... 160/236, 232, 160/237, 168.1 R, 168 V, 176.1 R, 176.1 V, 173 R, 172 R, 172 V, 34, 19, 184, 199, 166.1 R; 49/92.1

[56] References Cited

U.S. PATENT DOCUMENTS

| | | | |
|---|---|---|---|
| 2,068,977 | 1/1937 | Dodge | 160/236 |
| 2,074,482 | 3/1937 | Martens | 160/236 |
| 2,091,012 | 8/1937 | Pratt | 160/236 |
| 2,994,370 | 8/1961 | Pinto | 160/236 X |
| 4,078,492 | 3/1978 | Levy et al. | 160/238 X |
| 4,343,171 | 8/1982 | Kagawa | 160/236 X |
| 4,911,220 | 3/1990 | Hiller | 160/236 |
| 5,105,870 | 4/1992 | Merjane | 160/236 |
| 5,263,529 | 11/1993 | Landis | 160/236 |
| 5,271,447 | 12/1993 | Aronovich | 160/236 |
| 5,358,024 | 10/1994 | Schwaegerle | 160/236 |
| 5,443,563 | 8/1995 | Hindel et al. | 160/238 |

*Primary Examiner*—David M. Purol

[57] ABSTRACT

A decorative system for use with louvered covering devices, such as Venetian blinds or mini-blinds, is designed to decorate individual movable slats associated with the louvered coverings. Several different embodiments of decorative coverings are disclosed, to include decals, engravings, removable decorative panels positionable within hollow transparent slats, and removable decorations which overlay the existing slats.

1 Claim, 4 Drawing Sheets

DECORATIVE BLIND

BACKGROUND OF THE INVENTION

1. Field of the Invention

The present invention relates to louvered coverings and more particularly pertains to a several different types of decorations which can be affixed to such louvered coverings.

2. Description of the Prior Art

The use of decorations to improve the aesthetic appearance of louvered coverings is well known in the prior art. For example, U.S. Pat. No. 4,930,562, which issued to Goodman on Jun. 5, 1990, discloses a decorative member for attachment to a vertical slat associated with a window covering blind structure. The decorative member includes a substrate which fits into the blind slat and a cover member which is attached to the substrate so as to cover the exposed edges of the blind slat to which the member is attached. The decorative member can be provided with any type of ornamentation or depiction which improves the aesthetic appearance of the overall blind arrangement.

Another patent of interest is U.S. Pat. No. 4,911,220 which issued to Hiller on Mar. 27, 1990. This patent discloses a louver cover designed to maximize the decorative valve of a louver used in louvered window coverings and the like. The louver cover includes an elongate tubular body having dimensions sufficient to enclose a louver therein. The louver cover may be attached to a louver by snaps provided on one end of the tubular body, and the cover is constructed of a flexible fabric which is dyed or imprinted with an image. When associated with a plurality of louvers, the plurality of louver covers are positioned and colored to provide a large composite image to viewers on either side of the louvered covering. The louver cover is removable and thus provides for a variation of the color and function of the louvers presently in a consumer's home.

As opposed to using removable decorative covers, the use of a decorative decal system is also known in the prior art. For example, U.S. Pat. No. 5,263,529, which issued to Landis on Nov. 23, 1993, discloses a decorative decal system for louvered devices, such as venetian blinds or mini-blinds, wherein such system utilizes a series of easily removable adhesive backed decal strips for application to louvered blinds or windows. Each decal strip contains a segment of a decorative design or other indicia, and when all of the segments are applied to a series of louvers in a blind, the group of decal strips forms a unitary pattern on the blind.

As such, it can be seen that the concept of utilizing removable decorations on louvered blinds is covered by these above-discussed patents. While each of these prior art patents disclose decorative coverings which fulfill there respective objectives and requirements, and are most likely quite functional for their intended purposes, it will be noticed that each involves a specific method of attachment which might be described as complex. For example, the decorative coverings disclosed in the Goodman and Hiller patents are utilizable only on vertical slats of a blind structure and are not particularly and easily adaptable for use with a horizontal slat structure as found in most Venetian and mini-blinds. While the decorative system utilized in Landis is utilizable with horizontal slats, a tedious and time consuming process would be involved to adhesively attach a decorative decal to each of the individual slats. Once attached, there is very little likelihood that a consumer would want to go through the difficult procedure of removing decals to replace them with decals depicting a different composite image and as such, there appears to still exist the need for an easily removable and exchangeable decorative system for louvered coverings. In this respect, the present invention substantially fulfills this need.

SUMMARY OF THE INVENTION

In view of the foregoing disadvantages inherent in the known types of decorative blinds now present in the prior art, the present invention provides a new decorative blind wherein the same can be utilized to present an aesthetically pleasing decorative scene or design and wherein such decorative scene or design can be occasionally and easily exchanged for a different decorative scene or design. As such, the general purpose of the present invention, which will be described subsequently in greater detail, is to provide a decorative blind and method which has many of the advantages of the decorative blinds mentioned heretofore and many additional novel features that result in a decorative blind which is not anticipated, rendered obvious, suggested, or even implied by any of the prior art decorative blinds, either alone or in any combination thereof.

To attain this, the present invention generally comprises a decorative system for use with louvered covering devices, such as Venetian blinds or mini-blinds, which is designed to decorate individual movable slats associated with the louvered coverings. Several different embodiments of decorative coverings are disclosed to include decals, engravings, removable decorative panels positionable within hollow transparent slats, and removable decorations which overlay the existing slats.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new decorative blind and method which has many of the advantages of the decorative blinds mentioned heretofore and many novel features that result in a decorative blind which is not anticipated, rendered obvious, suggested, or even implied by any of the prior art decorative blinds, either alone or in any combination thereof.

It is another object of the present invention to provide a new decorative blind which may be easily and efficiently manufactured and marketed.

It is a further object of the present invention to provide a new decorative blind which is of a durable and reliable construction.

An even further object of the present invention is to provide a new decorative blind which is susceptible of a low cost of manufacture with regard to both materials and labor, and which accordingly is then susceptible of low prices of sale to the consuming public, thereby making such decorative blind economically available to the buying public.

Still yet another object of the present invention is to provide a new decorative blind which provides in the apparatuses and methods of the prior art some of the advantages thereof, while simultaneously overcoming some of the disadvantages normally associated therewith.

Still another object of the present invention is to provide a new and improved decorative blind which facilitates the use of easily removable and exchangeable decorations so as to facilitate an occasional change of appearance of said decorative blind.

Yet another object of the present invention is to provide a new and improved decorative blind which provides for a quickly changeable appearance as desired.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF PREFERRED EMBODIMENTS

Figure 1:
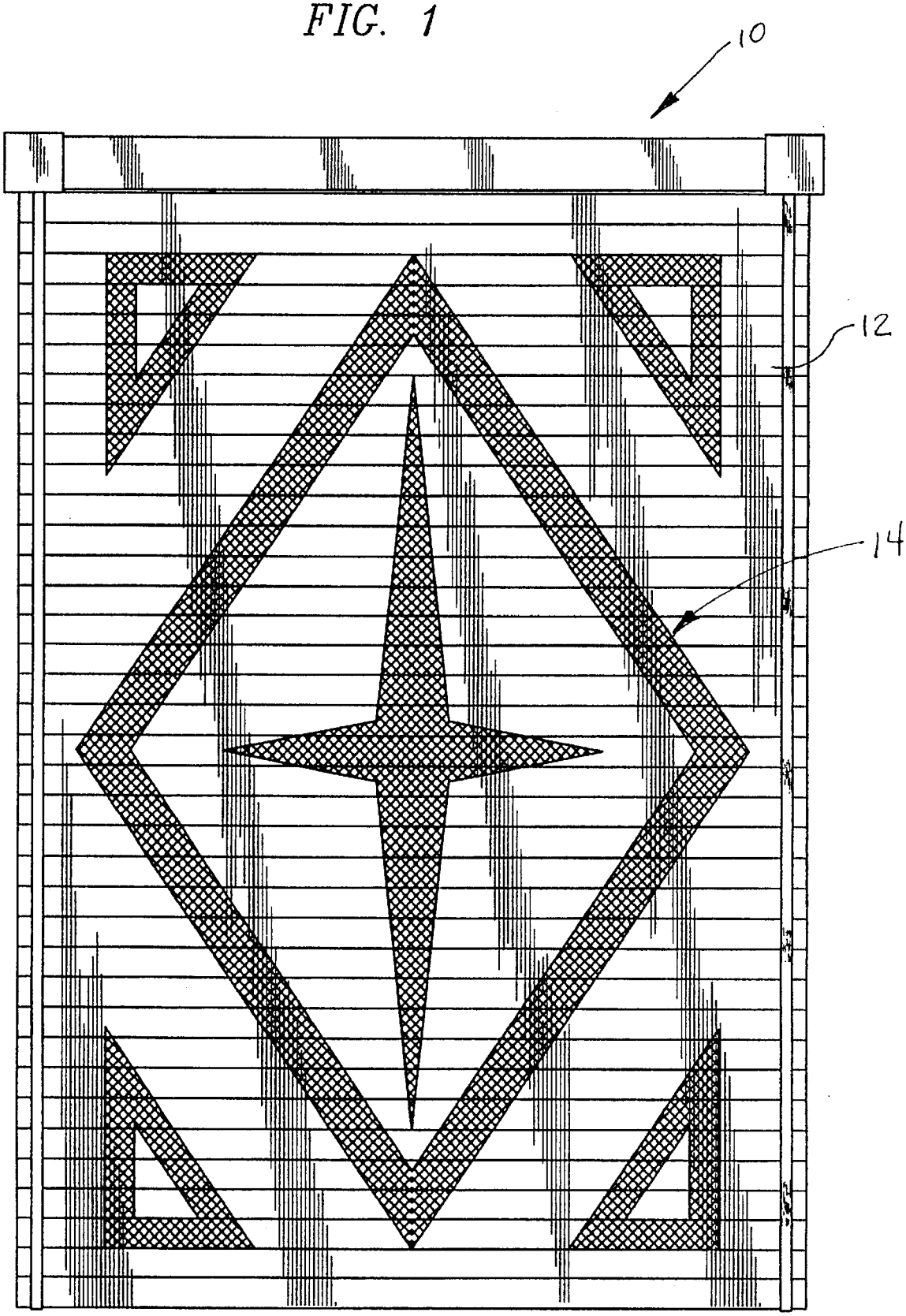
FIG. 1 is a front elevation view of one embodiment of a decorative blind comprising the present invention.
Figure 2:
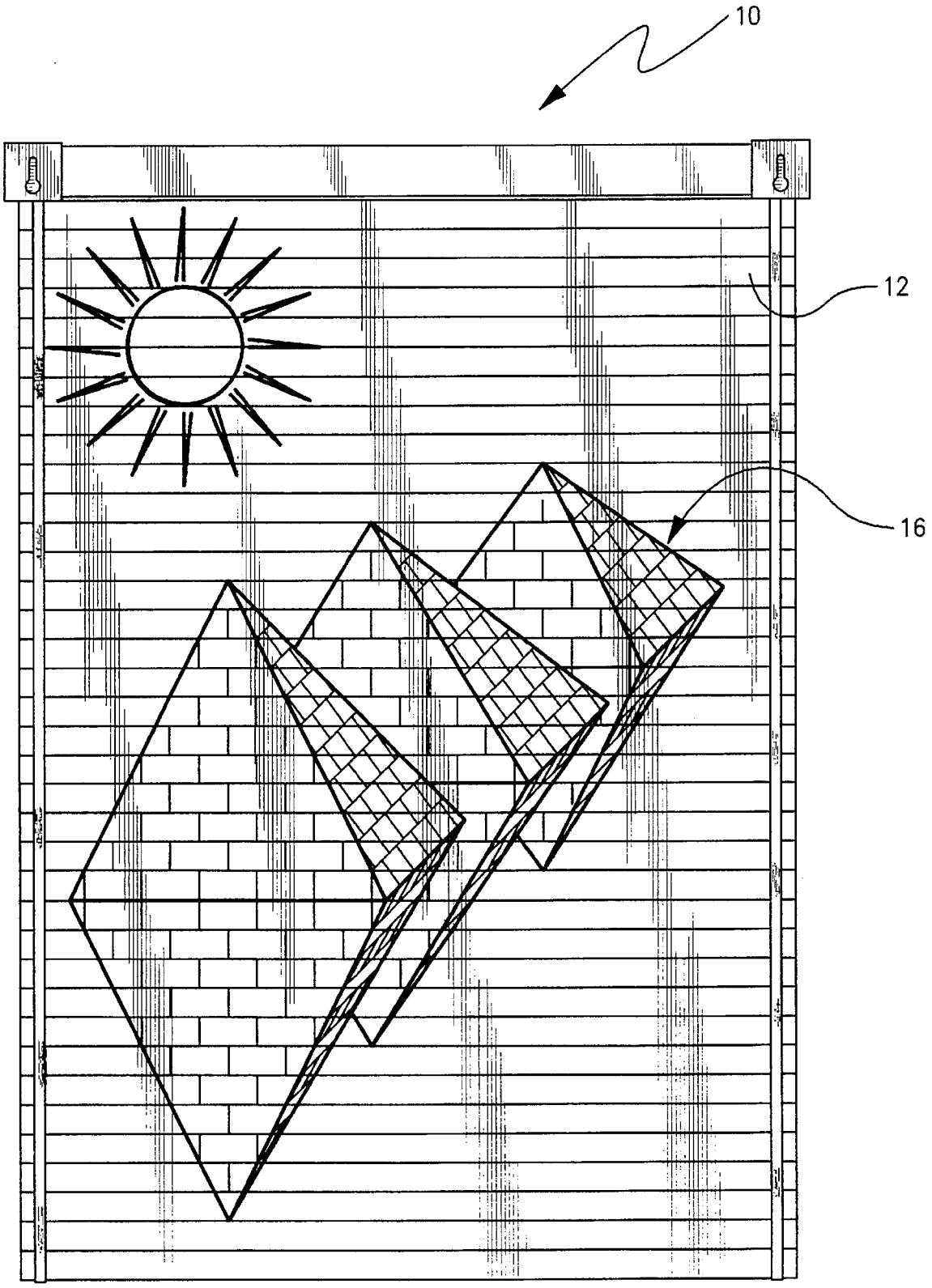
FIG. 2 is a rear elevation view of the invention shown in FIG. 1.
Figure 3:
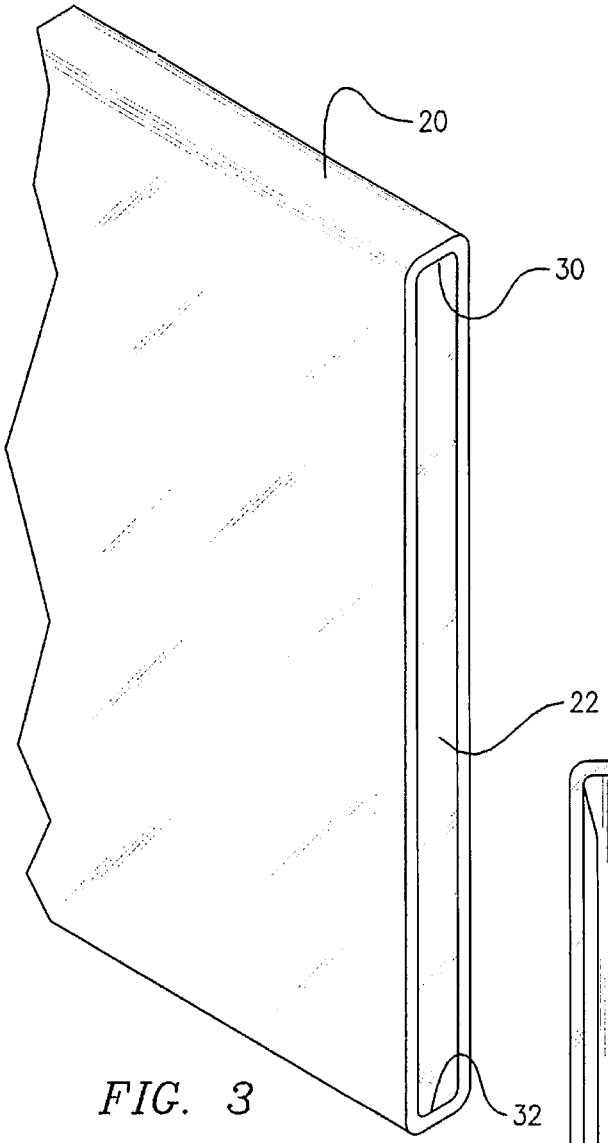
FIG. 3 is a partial perspective view of a transparent slat utilized in one embodiment of the present invention.

With reference now to the drawings, and in particular to FIGS. 1 and 2 thereof, a new decorative blind embodying the principles and concepts of the present invention and generally designated by the reference numeral 10 will be described.

More specifically, it will be noted that the decorative blind 10 essentially consists of a plurality of aligned slats 12 which lie in a parallel, juxtaposed relationship and which are selectively openable and closeable in a conventional and well known manner. As illustrated in FIG. 1, the basic concept of the present invention 10 is to provide a composite design or scene 14 which is visible when the slats 12 are in a closed position as illustrated. A separate and different design or scene 16 is illustrated on a rear panel of the decorative blind 10 when the slats 12 are in a closed position as shown in FIG. 2.

The designs or scenes 14, 16 are illustrative of the multitude of designs and scenes which are within the intent and purview of the present invention and which are intended to be encompassed by the claims appended hereto. Scenes provided on the blind 10 could include enlarged photographs of oceans, cities, mountains, and the like, as well as photographs of people or animals. Humorous scenes could be provided such as an enlarged photograph of a bank check, and also the designs could recreate curtain patterns as displayed by curtains located proximate the blind 10. Other conceptual scenes and designs could involve the choice of colors, fruit, geometric patterns, carpet patterns, religious symbols or depictions, holiday decorations, with this list being obviously and apparently endless.

Various methods of imprinting or attaching the scenes and designs 14, 16 can be utilized and are intended to be a part of this application. For example, if the slats 12 are formed of wood, woodburning, carving, or other engraving techniques could be utilized to form a permanent design or scene on the louvered covering 10. If the slats 12 are formed of plastic or metal, similar to those which are presently commercially available, painting, removable decals, overlays, and the like, represent methods of scene or design attachment to the individual slats so as to form a composite aesthetically pleasing picture.

Figure 4:
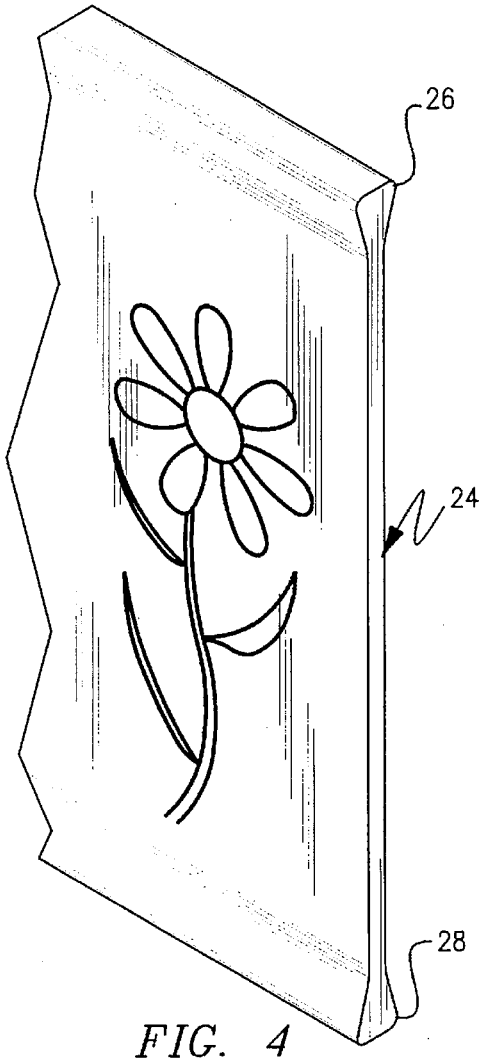
FIG. 4 is a partial perspective view of a decorative insert utilizable in the slat shown in FIG. 3.
Figure 5:
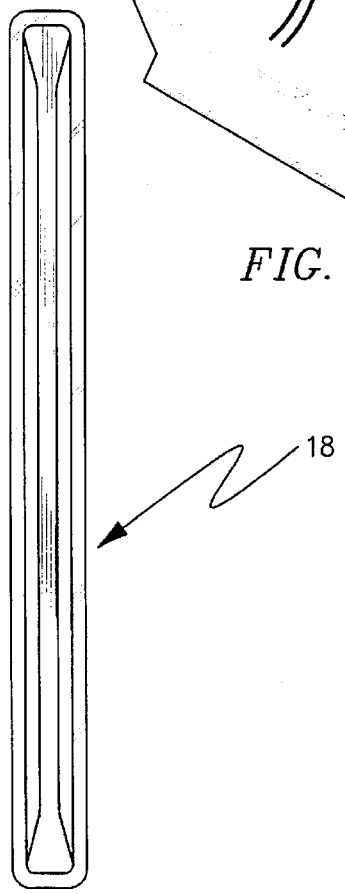
FIG. 5 is an end elevation view illustrating the decorative insert positioned within the slat of FIG. 3.

Irrespective of the various methods which can be utilized to decorate the slats 12 associated with the blind 10, one preferred embodiment 18 of the present invention involves the use of a plurality of substantially flat slats 20, each of which is formed of a transparent plastic material and has a hollow interior 22 extending along the entire axial length thereof. The hollow interior 22 is designed to receive an elongate decorative insert 24 as shown in FIGS. 4 and 5. The decorative insert 24 is of a flat rectangular shape and includes opposed enlarged bulbous edges 26, 28 which are frictionally engagable with respective end side walls 30, 32 of the hollow interior 22.

The decorative insert 24 will be of a substantially rigid construction and can be formed of any material which would provide such rigidity, to include a hard robber, plastic, metal, wood, etc. Only the ends 26, 28 of the decorative inserts 24 are designed to engage the side walls 30, 32 of the hollow interior 22, thereby to lessen the difficultly associated with inserting the insert into the hollow interior 22, as well as withdrawing the same therefrom. If frictional engagement was caused to occur along the entire surface area of the decorative insert 24 as occasioned by its abutting relationship with the entire surface area of the hollow interior 22, substantial difficulty could be encountered in completely inserting or withdrawing the insert from the slat 20.

Figure 6:
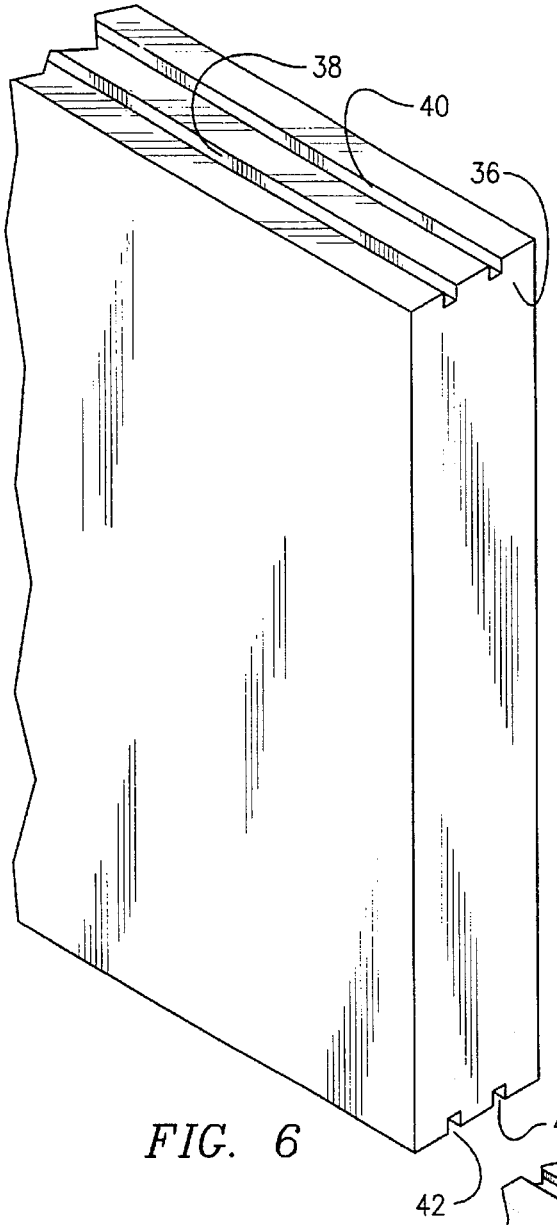
FIG. 6 is a partial perspective view of a non-transparent slat utilizable in another embodiment of the present invention.
Figure 7:
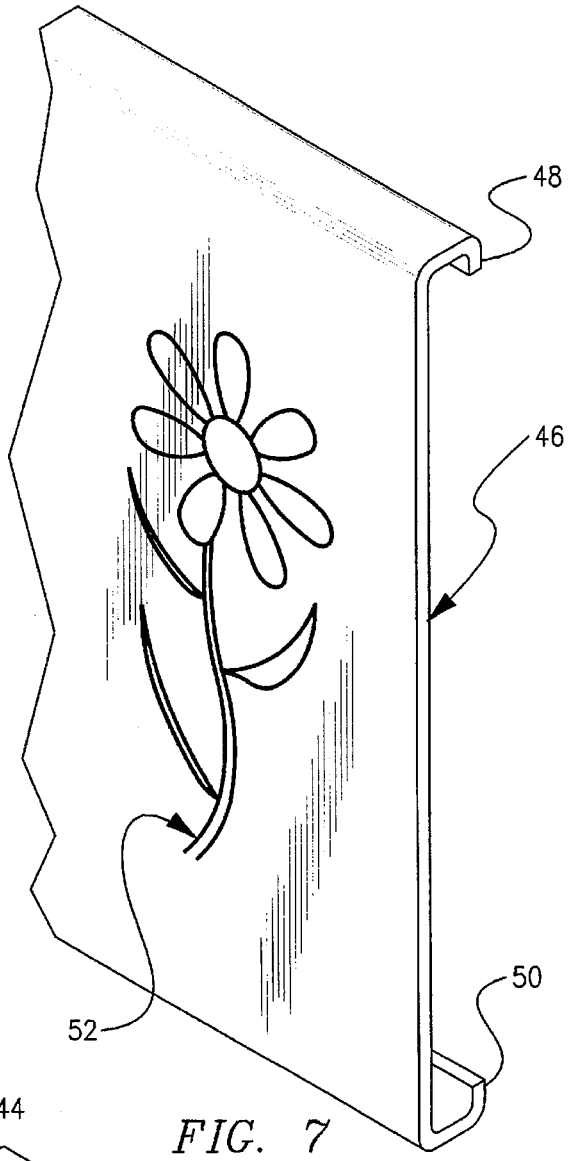
FIG. 7 is a partial perspective view of a snap-on decoration utilizable with the slat shown in FIG. 6.
Figure 8:
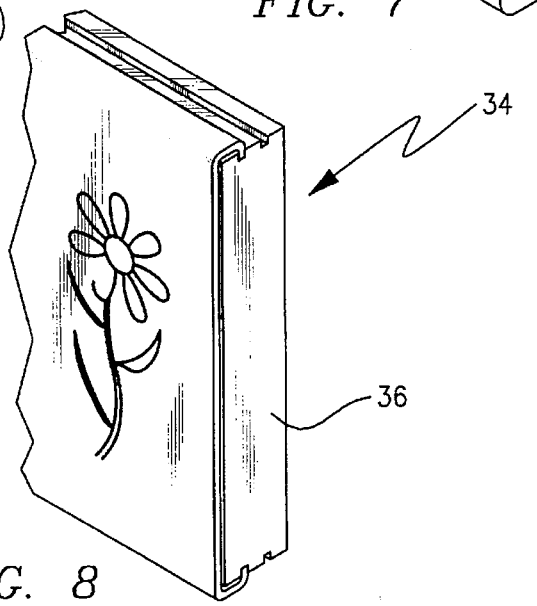
FIG. 8 is a partial perspective view illustrating the decorative overlay of FIG. 7 operatively attached to the slat of FIG. 6.

FIGS. 6, 7 and 8 disclose a second embodiment 34 of the invention 10 wherein this embodiment is utilizable with slats 36 which are formed of a non-transparent material. As shown, each slat 36 is provided with a pair of topmost aligned grooves 38, 40 and a further pair of bottom-most aligned grooves 42, 44. The grooves 38, 40, as well as the grooves 42, 44, are parallelly aligned and extend along the entire axial length of each slat 36.

A decorative overlay 46 is of a substantially U-shaped construction and is formed of a resilient material which allows some deformation to facilitate an attachment thereof to the slat 36. Each overlay 46 includes oppositely disposed lips 48, 50 which may be resiliently deformed so as to be snap-fitted into the opposed grooves 38, 42 of the slat 36 as best illustrated in FIGS. 8. A second overlay 46 may be attached to an opposite side of the slat 36 by being deformably snap-fitted into the opposed grooves 40, 44 in a now apparent manner. The decorative overlay 46 would preferably be formed of a hard plastic material and a pleasing design or scene 52 would be imprinted thereon. As can be appreciated, the design or scene 52 could be part of a composite picture whereby a plurality of decorative overlays 46 would have to combined in a proper sequence over a plurality of slats 36 so as to illustrate the total design or scene as aforedescribed. This second embodiment 34 of the invention, as well as the first embodiment 18, provides for a quick and easy method of changing a composite design or scene on a decorative blind 10, thereby to eliminate the difficulties of using paints, adhesives, decals, and the like.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A new and improved decorative louvered window covering, said decorative louvered window covering including:

a louvered blind assembly consisting of a plurality of separately movable slats, said slats being selectively controllable and alignable to form a continuous shade for said window so as to substantially cover an opening defined by said window; and a decorative covering substantially superposed over said continuous shade, said decorative covering at least partially imparting a decorative and aesthetic appearance to at least one visible side of said continuous shade;

said decorative covering is of a selectively changeable construction including a plurality of decorative individual panels which can be properly aligned to create said decorative covering as a composite image and Which are individually attachable to individual slats forming said louvered blind assembly, each decorative individual panel having a rectangular shape with opposed enlarged bulbous edges;

said slats are each formed from a transparent material and include a hollow interior section, and further wherein at least one of said decorative individual panels is removably positionable as an insert within said hollow interior section such that only the bulbous edges thereof are frictionally engagable with respective side walls of the hollow interior, thereby to create said decorative covering;

said decorative individual panels are exchangeable with a different decorative panel, thereby to provide said selectively changeable construction;

said decorative covering includes an enlarged photograph permanently affixed to at least one of said decorative individual panels;

said louvered blind assembly comprises at least one of a mini-blind, a vertical hanging blind, and a venetian blind, wherein said louvered blind assembly is designed to cover at least one of a window opening and a door opening.

* * * * *